United States Patent [19]

Breguet

[11] 4,204,396

[45] May 27, 1980

[54] WATCH

[75] Inventor: Jean-Luc Breguet, La Chaux-de-Fonds, Switzerland

[73] Assignee: Ebauches S.A., Neuchatel, Switzerland

[21] Appl. No.: 875,562

[22] Filed: Feb. 6, 1978

[30] Foreign Application Priority Data

Feb. 16, 1977 [CH] Switzerland ..... 1888/77

[51] Int. Cl.[2] ..... G04B 37/04; G04C 3/00

[52] U.S. Cl. ..... 368/287; 368/280; 368/300

[58] Field of Search ..... 58/23 R, 50 R, 85.5, 58/88 C, 88 SC, 88 M

[56] References Cited

U.S. PATENT DOCUMENTS

| | | | |
|---|---|---|---|
| Re. 29,551 | 2/1978 | Zurcher et al. | 58/88 C |
| 1,582,733 | 4/1926 | Clark | 58/88 C |
| 3,492,810 | 2/1970 | Levrat | 58/88 C |
| 3,735,584 | 5/1973 | Tokunaga | 58/88 C |
| 4,009,564 | 3/1977 | Zurcher | 58/23 R |
| 4,092,820 | 6/1978 | Kume et al. | 58/23 R |

FOREIGN PATENT DOCUMENTS

| | | | |
|---|---|---|---|
| 1029191 | 6/1953 | France | 58/88 C |

*Primary Examiner*—S. J. Witkowski

*Attorney, Agent, or Firm*—Silverman, Cass & Singer, Ltd.

[57] ABSTRACT

An improved shock absorber for a watch movement and a method of making the same. The watch has a molded casing and a movement with a molded baseplate. A plurality of shock absorbers permanently mount the movement in the casing. Each shock absorber has a first portion molded in the watch casing, a second portion molded in baseplate of the watch movement, and an elastically deformable shock absorber connecting portion extending between the first portion and the second portion free of the casing and the baseplate. The method includes molding the first portion in the casing and molding the second portion in the baseplate with the connecting portion free of the baseplate and casing and the baseplate and casing free from one another.

12 Claims, 7 Drawing Figures

WATCH

The present invention relates to a watch having a movement including a base-plate, said movement being located in a casing.

This watch is characterized by the fact that the movement is maintained permanently in the casing by elastically deformable means connecting the base-plate and the casing, the deformable means acting as a shock absorber.

The drawing shows, by way of example, several embodiments of the invention.

Figure 1:
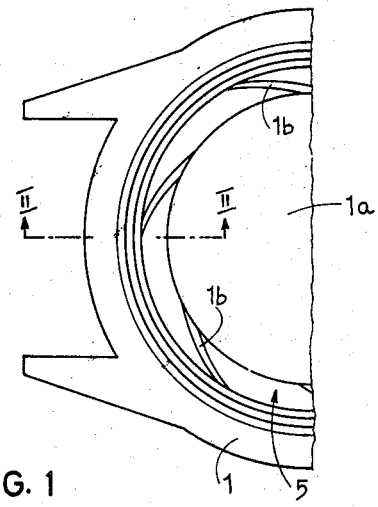
FIG. 1 is a plan view of a portion of a first embodiment of a watch the crystal and the dial of which have been removed.
Figure 2:
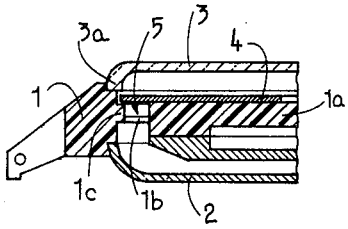
FIG. 2 is a radial sectional view of a portion of this watch, along line II—II of FIG. 1.

The watch represented in FIGS. 1 and 2 comprises an electronic movement located in a casing comprising a combined bezel and case-band, or case-body 1 of plastic material, carrying a bottom 2 and a crystal 3.

The case-body 1 is made integral with the base-plate 1*a*, of the movement, to which is secured the dial, designated by 4. An annular free-space 5 is provided between the base-plate 1*a* and the case-body 1, with the free space being traversed by resiliently deformable arms 1*b*, made integral with the base-plate and with the case-body, ensuring the connection between these two elements. These arms 1*b* are arc-shaped as shown by FIG. 1, so that they damp or absorb the radial shocks to which the movement is submitted. Moreover, since they are relatively thin, they yield when the movement is submitted to axial shocks, and thus absorb the axial shocks too. The periphery of the dial 4 is engaged between the edge 3*a*, of the crystal 3, and a shoulder 1*c* of the case-body 1. Thus, the dial 4 serves to limit the radial and axial displacements of the movement.

Figure 4:
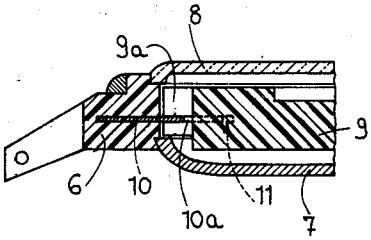
FIG. 4 is a radial sectional view of a portion of this watch, along line IV—IV of FIG. 3.
Figure 3:
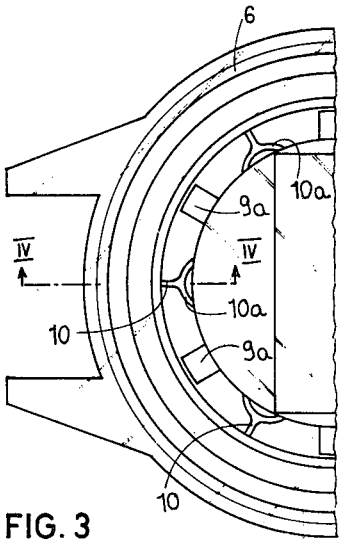
FIG. 3 is a plan view of a second embodiment of a watch shown during its manufacture.

In the embodiment of FIGS. 3 and 4, the casing of the watch represented comprises also a case-body 6, of plastic material, carrying a bottom 7 and a crystal 8.

The electronic movement comprises a base-plate 9, also made of plastic material. Resilient metal blades 10 have one end embedded in the material of the case-body 6 and have their other end, which is fork-shaped, embedded in the material of the base-plate 9. The branches 10*a*, of these fork-shaped ends give a greater rigidity to the device, which facilitates the manufacture of the watch. At the end of the process manufacture, one cuts one of the branches 10*a*, which permits the radial displacements of the base-plate. As for the axial shocks to which the movement is submitted, they are absorbed by the flextion of the elastic blades 10.

It is to be noted that the plate 9 is provided with radial ears 9*a*, extending in the annular free-space situated between the base-plate 9 and the case-body 6, and which both limit the radial displacement or travel of the movement while abutting against the case-body, and the axial displacement or travel while abutting against the bottom 7 or against the crystal 8, according to the direction in which the axial shocks are applied.

Figure 5:
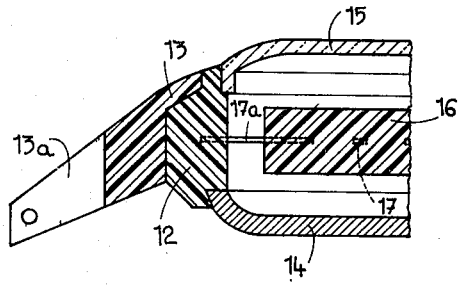
FIG. 5 is a radial sectional view of a portion of a third embodiment of a watch.
Figure 6:
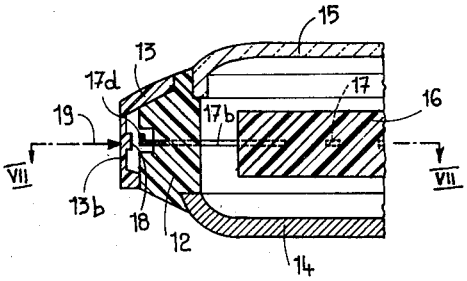
FIG. 6 is a radial sectional view, passing through a diameter other than that of FIG. 5, of a portion of the watch.
Figure 7:
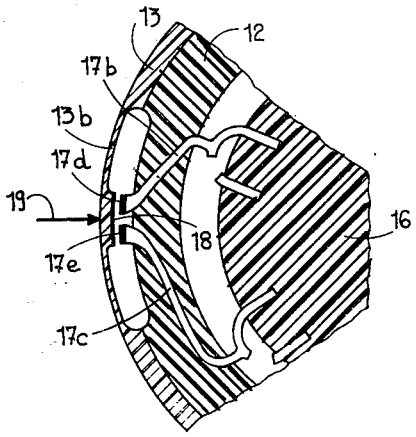
FIG. 7 is a sectional view of a portion of this watch along line VII—VII of FIG. 6.

In the embodiment of FIGS. 5 to 7, the casing of the watch represented comprises a case-body 12, of plastic material, surrounded by a cap 13, plastic material also, provided with horns 13*a* to which the bracelet of the watch is secured. The bottom and the crystal of the watch are designated by 14 and 15 respectively. The base-plate 16 of the movement, of plastic material, is molded over a metal grid 17. The elements of this grid, separated from each other by a cutting operation effected after the overmolding operation, constitute conductive members of the electronic circuit of the movement.

Some elements of the grid 17 such as the arms 17*a*, 17*b* and 17*c*, for instance, go beyond the base-plate 16 and engage the material of the case-body 12. These elements are constituted of metal thin small tongues which are elastically deformable, ensuring the dampening of the radial shocks as well as the axial shocks to which the movement is submitted. These various arms are terminated, at the side of the movement, by fork-shaped portions, one of the branches of which has been cut at the end of the manufacturing operation, as shown by FIG. 7. This ensures the dampening of the radial shocks, in the same way as the cut branches 1*b* of the first embodiment.

While the outer ends of the small tongues 17*a* are embedded in the material of the case-body 12, the outer ends 17*d* and 17*e* of the small tongues 17*b* and 17*c* which ends are bent at right angles, are situated outside the case-body. The lateral wall of the cap 13 is provided with a thinner portion 13*b* situated opposite the ends 17*d* and 17*e* of the arms 17*b* and 17*c* and is provided innerly at the center of the said thinner portion, with an electrically conductive coating 18. While exerting a pressure on this thinner portion 13*b*, in the direction of the arrow 19 of FIGS. 6 and 7, one deforms the wall 13*b* and brings the conductive coating 18 into contact with the two ends 17*d* and 17*e* of the arms 17*b* and 17*c*, thus connecting them electrically to each other, which one permits to control some of the functions of the watch.

It is to be noted that the invention can be applied as well to mechanical watches as well as to electronic watches.

What I claim is:

1. A watch comprising:

a molded watch casing, a watch movement having a molded baseplate, shock absorbing means including elastically deformable means for permanently mounting said baseplate in said watch casing, said deformable means including a first portion molded into said casing, a second portion molded into said baseplate and a shock absorbing connecting portion extending between said first and second portions free of said casing and baseplate, said elastically deformable means are a plurality of arms laterally spaced around said baseplate between said baseplate and casing, with each arm including said first portion, said second portion and said connecting portion, and said arms are metallic tongues each having a bifurcated portion on one end thereof with at least a part of one bifurcation molded in one of said baseplate and said casing.

2. A watch as claimed in claim 1 in which said casing, said baseplate and said arms are made of plastic material.

3. A watch as claimed in claim 2 in which said arms are integrally formed with one of said casing and said baseplate.

4. A watch as claimed in claim 2 in which said arms are integrally formed with said casing and said baseplate.

5. A watch as claimed in claim 1 in which said movement includes electronic circuits, said baseplate includes at least a metallic grid molded in it, said grid being at least one of the conductors of the electronic circuits and said arms are integrally formed with said grid.

6. A watch as claimed in claim 5 in which at least one of said first portions of said arms passes through said casing to form a first contact at an outer surface of said casing opposite said movement, and said watch further includes switch means fixed on said outer surface of said casing and adjacent said first contact, said switch means including at least a second contact coupled to at least one of said electronic circuits and forming with said first contact a first pair of normally open contacts which are closed when said switch means are actuated to close at least one electronic circuit of said watch and control at least one function of said watch.

7. A watch as claimed in claim 6 in which at least a pair of said first portions of said arms pass through said casing to form a second pair of normally open contacts at the outer surface of said casing and said switch means including contact means adjacent said second pair of contacts for closing said second pair of normally open contacts when said switch means are actuated.

8. A watch as claimed in claim 6 in which said watch further includes a cap fixed on said outer surface of said casing and encircling said casing at said outer surface, said cap having a lateral wall adjacent said first contact and free of said casing, said wall having an elastically deformable zone and a conductive zone, said conductive zone being coupled to at least one of said electronic circuits and forming with said first contact a pair of normally open contacts which are closed when a pressure is exerted on said deformable zone of said cap to bring said conductive zone into contact with said first contact.

9. A watch as claimed in claim 8 in which said cap includes integral horns adapted for attaching a bracelet to said watch.

10. A watch as claimed in claim 1 in which said baseplate further includes ears extending from said baseplate towards said casing and free of said casing for limiting travel of said movement in said casing.

11. A watch comprising:

a molded watch casing.

a watch movement having a molded baseplate, shock absorbing means including elastically deformable means for permanently mounting said baseplate in said watch casing, said deformable means including a first portion molded into said casing, a second portion molded into said baseplate and a shock absorbing connecting portion extending between said first and second portions free of said casing and baseplate, said elastically deformable means are a plurality of arms laterally spaced around said baseplate between said baseplate and casing, with each arm including said first portion, said second portion and said connecting portion, and said casing, said baseplate and said arms are made of plastic material.

12. A watch as claimed in claim 11 in which each of said arms is arc shaped.

* * * * *